United States Patent [19]

Miller et al.

[11] 4,135,324

[45] Jan. 23, 1979

[54] ILLUMINATED DISC AIRFOIL TOY

[76] Inventors: Ronald L. Miller, 5959 Post Rd.; Henry A. Murray, II, 605 Kendal Rd., both of Nashville, Tenn. 37205

[21] Appl. No.: 783,842

[22] Filed: Apr. 4, 1977

[51] Int. Cl.[2] ..... A63H 27/00

[52] U.S. Cl. ..... 46/74 D; 46/228; 273/106 B

[58] Field of Search ..... 46/74 D, 75; 273/106 B, 273/106 D; 272/107

[56] References Cited

U.S. PATENT DOCUMENTS

| | | | |
|---|---|---|---|
| 3,545,760 | 12/1970 | Wilson | 46/74 D |
| 3,724,122 | 4/1973 | Gillespie, Sr. | 46/74 D |
| 3,786,246 | 1/1974 | Johnson | 240/6.4 D |
| 3,812,614 | 5/1974 | Harrington | 46/74 D |

*Primary Examiner*—Russell R. Kinsey
*Assistant Examiner*—Mickey Yu

[57] ABSTRACT

A rotatable, transparent plastic, disc-shaped aerial toy having a gull wing shape in diametrical cross-section and being equipped with a rechargeable L. E. D. lighting system which illuminates the entire toy so as to produce a giant lens effect.

4 Claims, 5 Drawing Figures

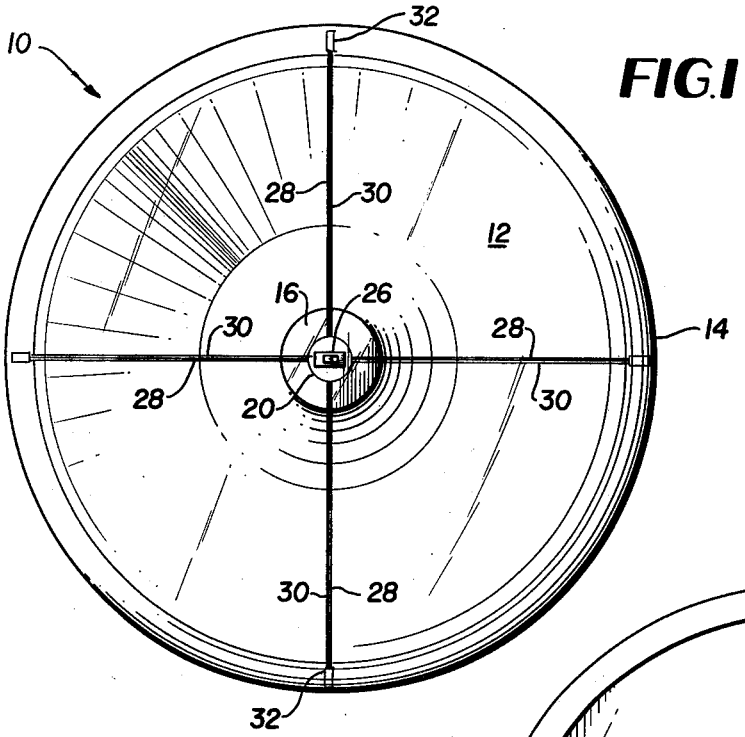
FIG.1
FIG.4
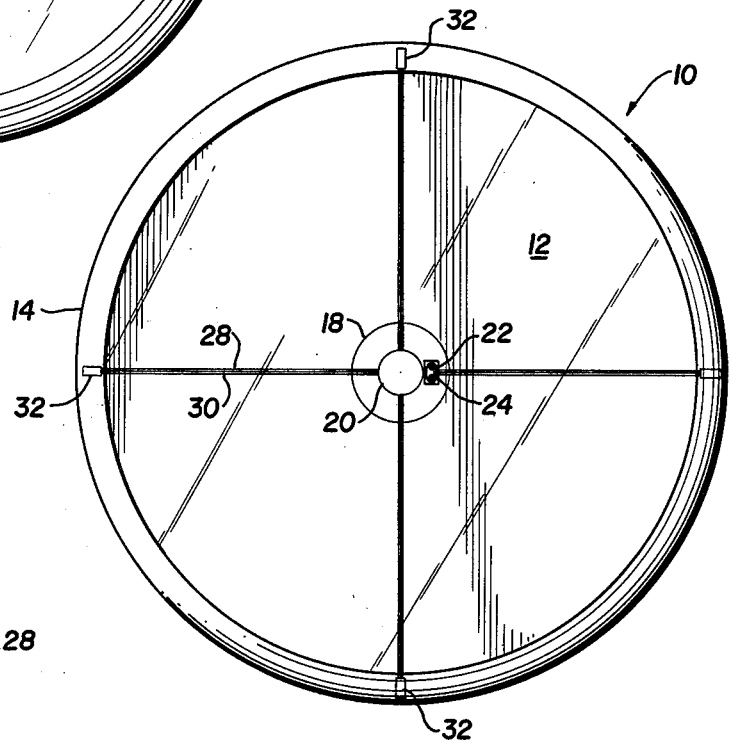
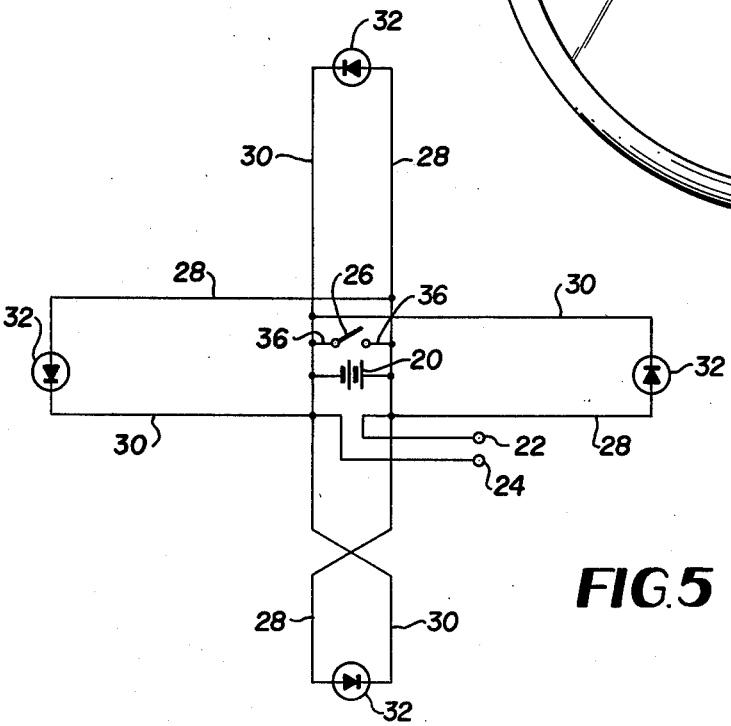
FIG.5

ILLUMINATED DISC AIRFOIL TOY

This invention relates generally to aerial toys which are thrown and caught by hand, and more particularly to an illuminable airfoil shaped disc.

Aerial toys of this general type are known in the art but, insofar as is known, these are generally characterized by a number of inherent disadvantageous features. Among these are: a poor design aerodynamically so as to have poor flight characteristics; poorly placed lights and the use of opaque disc material so as to render the illumination inadequate for after-dark use of the aerial toy; and a poor choice of disc materials resulting in early breakage of the disc or a dislodging of the lighting components.

Accordingly, the main object of the present invention is to provide an improved aerial toy which will obviate the above and other objectionable features of known devices.

An important object of the present invention is to provide an improved aerial toy which has a novel aerodynamic shape which will afford superior flight characteristics.

Another important object of the present invention is to provide a rotatable disc-like aerial toy formed of tough flexible transparent plastic so as to be free of breakage or electrical component dislodgement problems.

A further important object of the present invention is to provide a balanced transparent aerial toy which has an adequate and unique rechargeable L. E. D. lighting system so as to be usable at night without fear of loss of the toy.

A still further important object of the present invention is to provide an improved illuminable disc-like aerial toy which is susceptible of ready and economic manufacture, and which is sturdy and of long life in use.

Other objects and advantages of the present invention will become apparent during the course of the following description.

In the drawings, we have shown one embodiment of the invention. In this showing:

FIG. 1 is a top plan view of the disc type aerial toy comprising the present invention;

FIG. 4 is a bottom plan view thereof; and

FIG. 5 is a schematic view of the electrical system employed.

Figure 2:
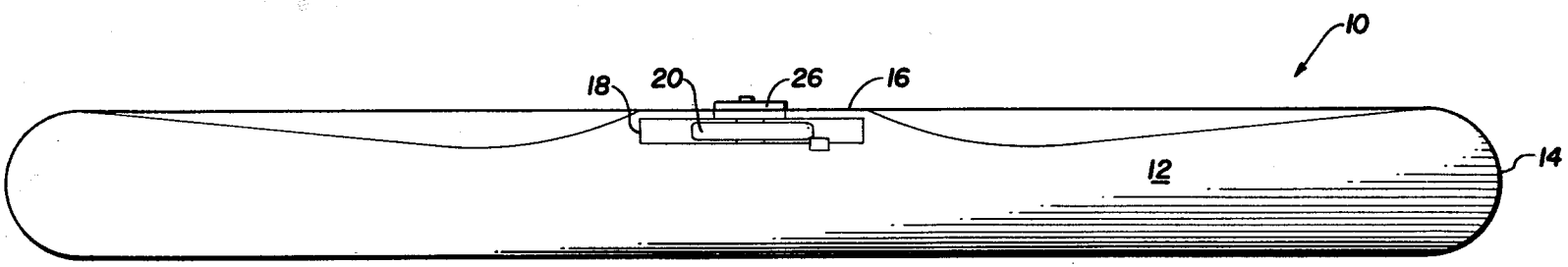
FIG. 2 is a side elevational view thereof.
Figure 3:
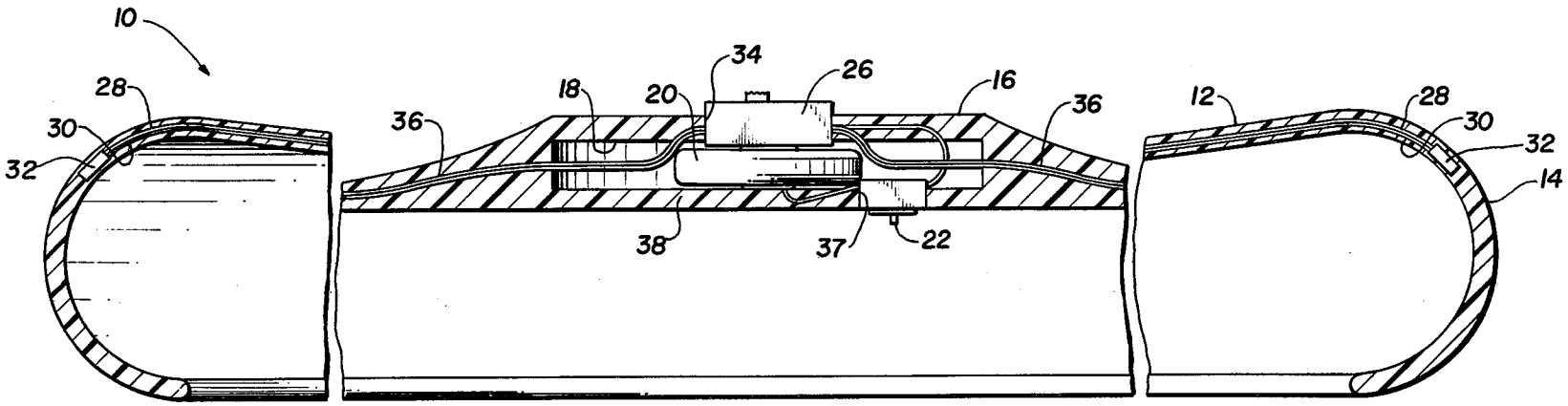
FIG. 3 is a central vertical, sectional view thereof.

Referring to the drawings, numeral 10 designates the aerial toy comprising the present invention as a whole which comprises a saucer-like disc 12 especially shaped to approximate in diametrical cross section, the gull wing shape of the airfoils of early aircraft. The disc thus becomes an airfoil whose upper surface inclines downwardly and inwardly from its arcuate periphery or heightened leading edge 14 and then curves upwardly to a thickened central portion 16 which includes a circular central cavity 18.

The disc 12 whose gull-wing shape materially enhances its lift characteristics and flight range when rotated about its axis by hand launching, is injection molded of clear transparent or color tinted transparent flexible plastic which is slightly crazed. Cellulose-acetate-butyrate is preferably employed but there are less expensive copolymers which can be used. The undersurface of the disc 12 is provided with a plurality of peripherally spaced recesses and grooves which connect (L. E. D.) light members positioned in the leading edge 14 with the rechargeable power supply which is positioned in the cavity 18.

The centrally balanced power supply comprises a button cell rechargeable battery 20 having a pair of receptacle pins 22, 24 for a recharging connection, a switch 26 for controlling the system, anode and cathode lead wires 28, 30 leading to unlensed light emitting diodes 32. The central cavity 18 has an upper aperture 34 for the passage of the anode and cathode leads 36 to the switch 26. A second aperture 37 is formed in the bottom cover 38 of the cavity 18 in line with the receptacle pins 22, 24 to facilitate the recharge connection. When all of the components, lamps wires, battery, connections, etc. have been soldered together and positioned in their various molded grooves and cavity, they are ultrasonicly sealed therein.

While the battery 20 may power any number of lights being GaAcP on GaP or GaAsP on GaAs which are unlensed, only four are shown. These unlensed light emitting diodes 32 inside of the periphery of the clear or slightly tinted plastic structure which is slightly crazed, will give the emitted light a refluxive nature which tends to disperse the light throughout the entire surface. Thus, the entire disc contains the light and glows to create a large optic fiber out of the total disc 12.

This totally illuminated disc will appear to be a large glowing lens when viewed from its top or its bottom and from the side, it will glow like a circle of light when rotatively thrown with sufficient velocity. Thus, a dimensional perspective of both velocity and angle of attack is afforded by the illuminated, gull-wing shaped aerial disc 12 throughout its improved flight span from thrower to receiver at night.

It is to be understood that the form of my invention herewith shown and described is to be taken as a preferred example of the same and that various changes in the shape, size and arrangement of parts may be resorted to without departure from the spirit of the invention or the scope of the subjoined claims.

We claim:

1. An aerial toy adapted to be rotatably thrown and caught by hand comprising a gull wing shaped, crazed transparent disc; said disc having an arcuate peripheral edge and an integral upper surface sloping inwardly and downwardly from said edge and finally upwardly to a closely adjacent thickened central body portion to constitute a gull wing air foil of enhanced lift characteristics to afford a maximum flight range path for the toy; the upper surface of said peripheral edge and of said central body portion lying in the same horizontal plane; said crazed transparent disc when illuminated, comprising a circular optic fiber to indicate the angle of attack.

2. The invention recited in claim 1, light means mounted in said disc; and power means connected with said light means and mounted centrally of said disc

3. The combination recited in claim 2 wherein said power means comprises a rechargeable battery.

4. The combination recited in claim 2 wherein said light means comprises one or more light emitting unlensed diodes.

* * * * *